US006447343B1

(12) United States Patent
Zhang et al.

(10) Patent No.: US 6,447,343 B1
(45) Date of Patent: Sep. 10, 2002

(54) ELECTRICAL CONNECTOR HAVING COMPRESSIVE CONDUCTIVE CONTACTS

(75) Inventors: Guohua Zhang; ZiQiang Zhu, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/909,577

(22) Filed: Jul. 20, 2001

(30) Foreign Application Priority Data

Jun. 8, 2001 (TW) ..... 90209562

(51) Int. Cl.[7] ..... H01R 13/24

(52) U.S. Cl. ..... 439/700; 439/824; 439/289; 439/482

(58) Field of Search ..... 439/700, 289, 439/482, 824, 66, 819–823; 324/761, 158 F

(56) References Cited

U.S. PATENT DOCUMENTS 5,295,839 A * 3/1994 Grange et al. ..... 439/824
5,388,997 A * 2/1995 Grange et al. ..... 439/66
6,334,796 B1 * 1/2002 Fromme et al. ..... 439/700
6,358,097 B1 * 3/2002 Peters ..... 439/700

* cited by examiner

*Primary Examiner*—Hien Vu
(74) *Attorney, Agent, or Firm*—Wei Te Chung

(57) ABSTRACT

An electrical connector (1) includes an insulative housing (2) and a number of compressive conductive contacts (3). The insulative housing has a top surface (20), a bottom surface (22) opposite to the top surface and a number of passageways (24) extending through the top and bottom surfaces. Each compressive conductive contact includes a rigid contacting portion (30) partially and movably protruding beyond the top surface, a rigid mounting portion (32) retained to the insulative housing and a compressive transitional portion (34) located between and electrically connecting the rigid contacting and mounting portions.

1 Claim, 4 Drawing Sheets

ELECTRICAL CONNECTOR HAVING COMPRESSIVE CONDUCTIVE CONTACTS

BACKGROUND OF THE INVENTION

1. Field of the Invention

The present invention relates to an electrical connector, and particularly to an electrical connector having compressive conductive contacts.

2. Description of the Related Art

Electrical connectors are often used to removably electrically interconnect electronic devices. U.S. Pat. Nos. 5,295,839 and 5,388,997 respectively disclose an electrical connector having a compressive conductive member and a rigid conductive member to cooperatively and electrically interconnect a pair of printed circuit boards.

However, the rigid and the compressive conductive members of the electrical connector of U.S. Pat. No. 5,295,839 are separate from each other and are respectively retained by different insulative members, which increases the number of components of the electrical connector and complicates assembling procedures. In addition, the rigid and the compressive conductive members and the insulative members may fall out of engagement between one another, thereby deteriorating the reliability of the signal transmission between the printed circuit boards.

On the other hand, the compressive conductive member of the electrical connector of U.S. Pat. No. 5,388,997 is directly retained to a printed circuit board and has no reliable fixation with an insulative member that supports the electrical connector and the rigid conductive member, such that it is apt to fall out of engagement with the insulative member and the rigid conductive member, thereby interrupting the signal transmission between the printed circuit boards. Thus, the reliability of the signal transmission between the printed circuit boards is not ensured.

Therefore, an improved electrical connector is required to overcome the disadvantages of the prior art.

SUMMARY OF THE INVENTION

A first object of the present invention is to provide an electrical connector having compressive conductive contacts reliably fixed to an insulative housing thereof to ensure a reliable signal transmission thereby; and A second object of the present invention is to provide a compact electrical connector having compressive conductive contacts.

An electrical connector in accordance with the present invention comprises an insulative housing and a plurality of compressive conductive contacts. The insulative housing defines a top surface, a bottom surface opposite to the top surface, and a plurality of passageways extending through the top and the bottom surfaces.

Each compressive conductive contact comprises a rigid contacting portion, a rigid mounting portion and a compressive transitional portion mechanically and electrically connecting the rigid contacting and mounting portions. The compressive conductive contacts are received in the passageways of the insulative housing, respectively. The rigid contacting portions of the compressive conductive contacts partially and movably protrude outwardly beyond the top surface of the insulative housing to electrically connect with an electronic device. The rigid mounting portions are retained to the insulative housing and partially protrude outwardly beyond the bottom surface of the insulative housing to electrically and mechanically connected to another electronic device, e.g., a printed circuit board, thereby establishing an electrical connection between the two electronic devices. The rigid contacting portions are movable along the passageways with respect to the insulative housing due to the flexibility of the compressive transitional portions.

Other objects, advantages and novel features of the invention will become more apparent from the following detailed description of the present embodiment when taken in conjunction with the accompanying drawings.

DETAILED DESCRIPTION OF THE INVENTION

Figure 1:
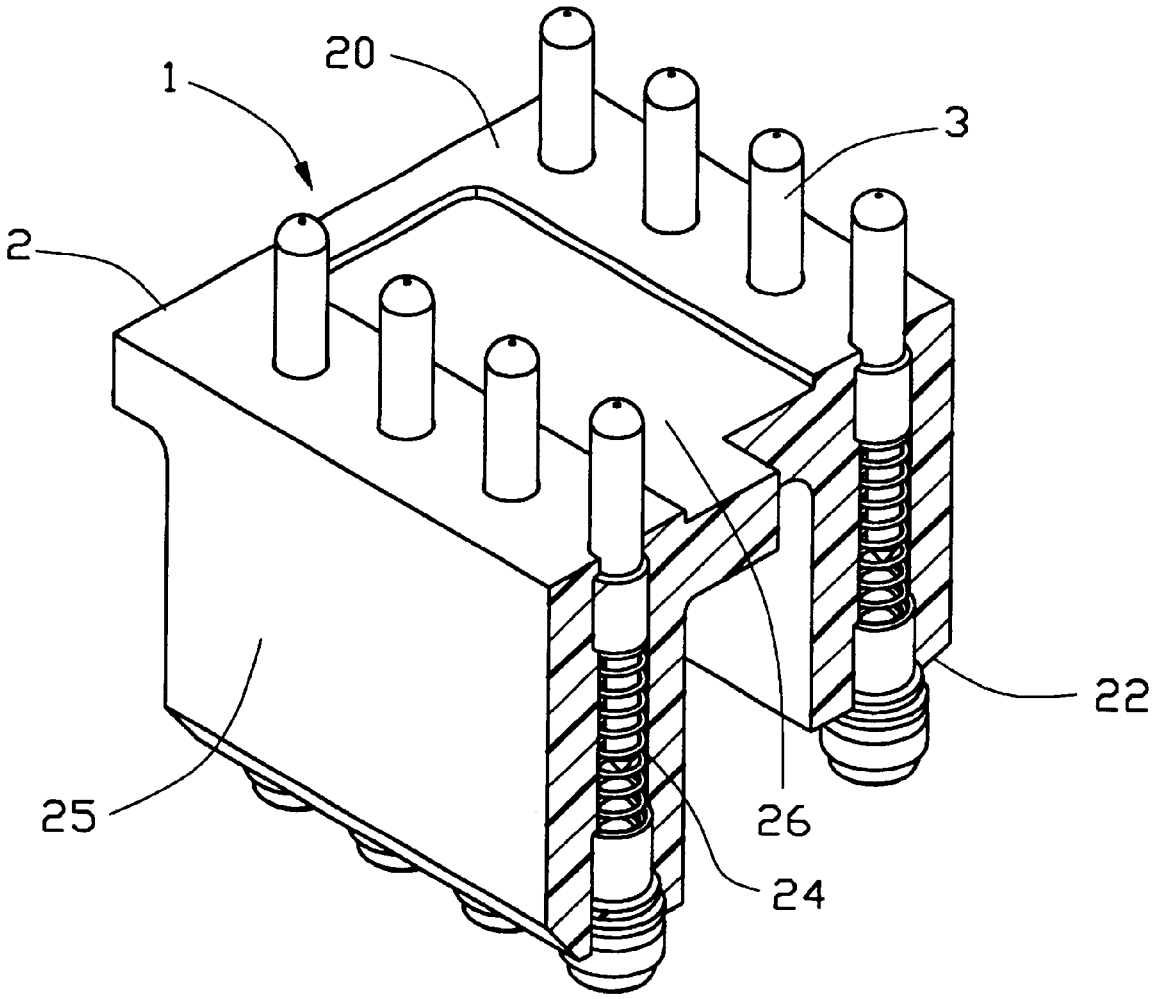
FIG. 1 is a partially cutaway perspective view of an electrical connector in accordance with the present invention.

Referring to FIG. 1, an electrical connector 1 in accordance with the present invention for interconnecting two electronic devices (not shown) comprises an insulative housing 2 and a plurality of compressive conductive contacts 3.

Figure 2:
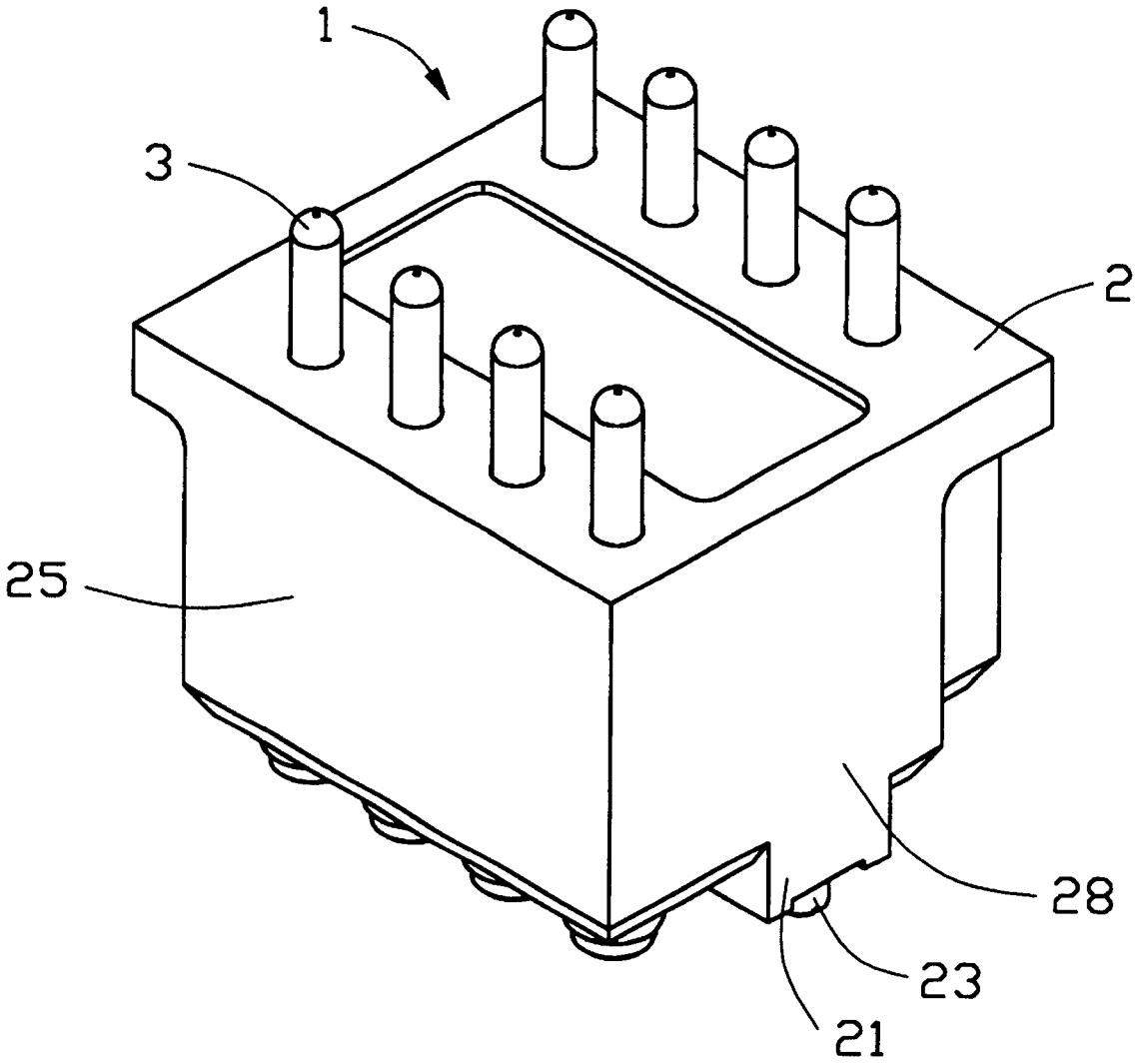
FIG. 2 is a perspective view of the electrical connector of FIG. 1.
Figure 3:
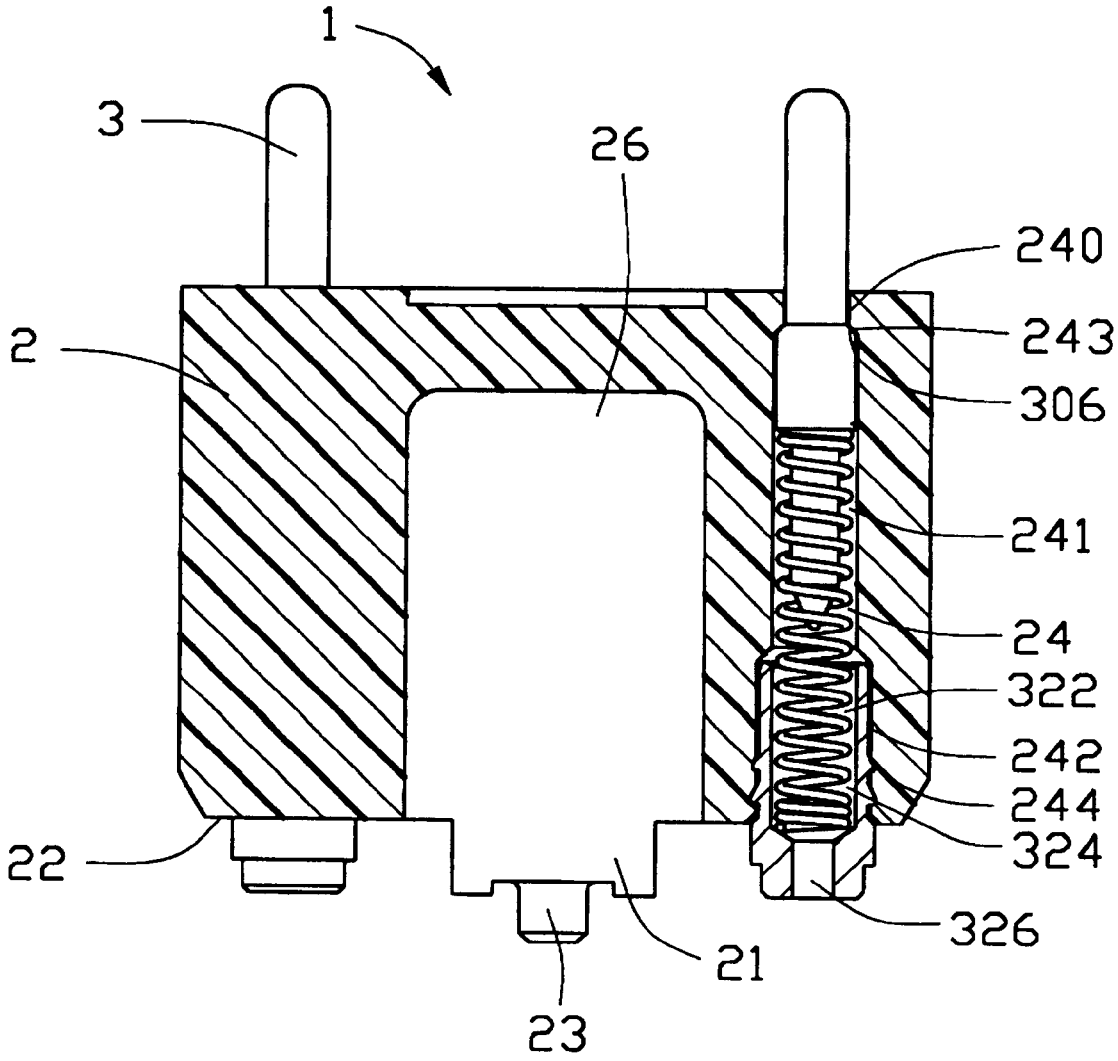
FIG. 3 is a cross-sectional view of the electrical connector of FIG. 1.

Referring also to FIGS. 2 and 3, the insulative housing 2 comprises a top surface 20, a bottom surface 22 opposite to the top surface 20 and a recess 26 recessed from a center portion of the bottom surface 22. The recess 26 has a pair of transversely opposite end walls 28 and a pair of longitudinally opposite side walls 25. Each end wall 28 comprises a block 21 protruding downwardly beyond the bottom surface 22. Each block 21 comprises a downwardly extending positioning post 23.

A row of passageways 24 extend in each side wall 25 and through the top and bottom surfaces 20, 22. As is clearly shown in FIGS. 1 and 3, each passageway 24 in one row aligns with none of the passageways 24 in another row. Each passageway 24 comprises a channel portion 240 in communication with the top surface 20, an accommodating portion 241 communicating with and being larger than the channel portion 240, and a retaining portion 242 in communication with both the accommodating portion 241 and the bottom surface 22. An inclined stop wall 243 is formed on an upper end of the accommodating portion 241 to partially separate the channel portion 240 and the accommodating portion 241. The retaining portion 242 is relatively larger than the accommodating portion 241 regarding to the size thereof. A plurality of slits 244 are defined in an inner wall of a lower portion of each retaining portion 242.

Figure 4:
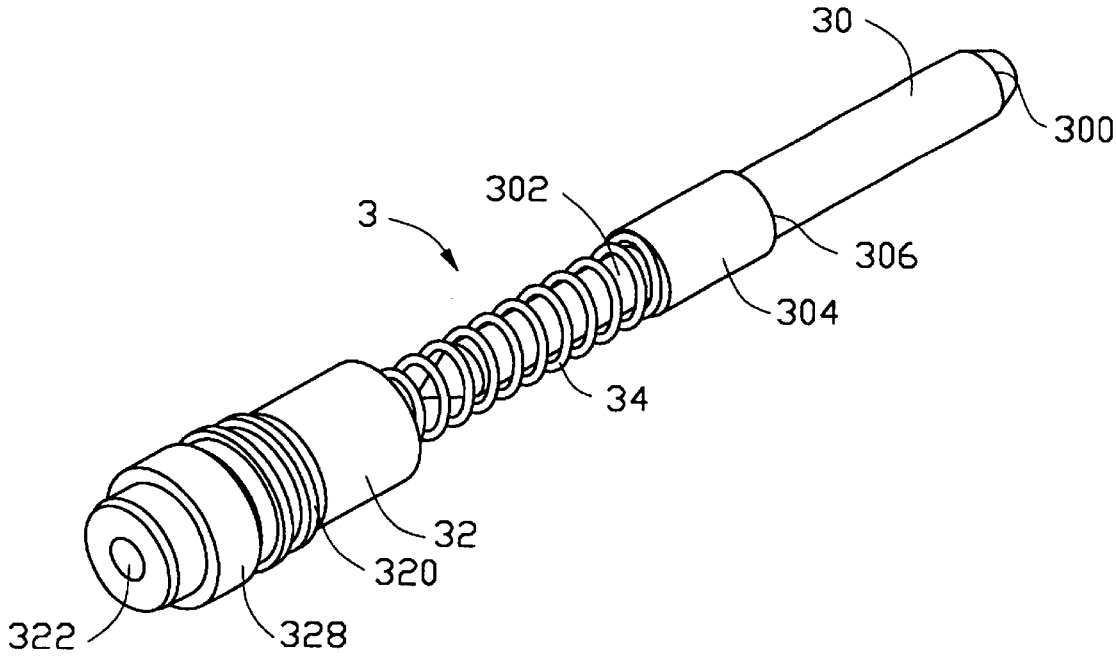
FIG. 4 is a perspective view of a compressive conductive contact of the electrical connector of FIG. 1.

Referring also to FIG. 4, each compressive conductive contact 3 comprises a generally cylindrical rigid contacting portion 30, a generally cylindrical rigid mounting portion 32 and a compressive transitional portion 34. The rigid contacting portion 30 includes a head section 300, a connecting section 302 and a middle section 304 between the head and the connecting sections 300, 302. The head sections 300 are curved on upper ends thereof, but could be in acute pointed end shapes on the upper ends thereof also, if desired. The middle sections 304 are larger than the head and the connecting sections 300, 302 and each has a shoulder 306 on an upper end thereof proximate to the head section 300. The rigid mounting portion 32 is formed with a plurality of barbs 320 at an outer surface of a lower end thereof and an enlarged section 328 located below the lower most barb 320. The rigid mounting portion 32 defines a through hole 322 extending along a whole length therethrough and comprising a receiving section 324 and a hole section 326. The receiving section 324 has an inner diameter corresponding to an inner diameter of the accommodating portion 241 of the passageway 24 and being larger than an inner diameter of the hole section 326. The compressive transitional portion 34, as is shown in drawings of the preferred embodiment of the present invention, is a spiral spring and could be adjusted to any desired configurations on condition that it has flexibility and it could be reliably retained to and electrically connected with the rigid contacting and mounting portions 30, 32. An inner diameter of the compressive transitional portion 34 is relatively larger than or equal to an outer diameter of the connecting section 302 of the rigid contacting portion 30. An outer diameter of the compressive transitional portion 34 is relative smaller than or equal to an inner diameter of the receiving section 324 of the rigid mounting portion 32.

In assembly, an end of the compressive transitional portion 34 of the compressive conductive contact 3 is accommodated in and retained to the receiving section 324 of corresponding rigid mounting portion 32 while another end of the compressive transitional portion 34 of the compressive conductive contact 3 receives and retains the connecting section 302 of the rigid contacting portion 30 in means known to one skilled in the pertinent art. In this way, the assembling procedure of the compressive conductive contacts 3 is achieved.

The assembled compressive conductive contacts 3 are inserted from the bottom surface 22 of the insulative housing 2 into the passageways 24, respectively, until the enlarged sections 328 of the rigid mounting portions 32 are stopped by the bottom surface 22. The head sections 300 of the rigid contacting portions 30 partially protrude beyond the top surface 20 of the insulative housing 2 while the shoulders 306 of the middle sections 304 are engageable with the stop walls 243 of the insulative housing 2 to prevent further movements thereof to escape from the insulative housing 2. The barbs 320 of the rigid mounting portions 32 engage with the slits 244 of insulative housing 2 to provide a reliable retention therebetween. In such an arrangement, the rigid contacting portions 30 of the compressive conductive contacts 3 are capable of moving in a distance defined between the stop walls 243 of the insulative housing 2 and the rigid mounting portions 32 due to the flexibility of the compressive transitional portions 34.

In use, the rigid mounting portions 32 are electrically and mechanically connected to an electronic device, e.g., a printed circuit board (not shown) while the rigid contacting portions 30 movably electrically connect with another electronic device, e.g., another printed circuit board (not shown), thereby an electrical connection between the two electronic devices being established.

The rigid contacting and mounting portions 30, 32 and the compressive transitional portions 34 of the compressive conductive contacts 3 are all reliably retained to the one piece insulative housing 2, so the number of components of the electrical connector 1 is decreased, assembling procedures of the electrical connector 1 are simplified and the reliability of the signal transmission is ensured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a top surface, a bottom surface opposite to the top surface and a plurality of passageways extending through the top and the bottom surfaces; and a plurality of compressive conductive contacts being received in the passageways of the insulative housing, respectively, each compressive conductive contact having a rigid contacting portion, a rigid mounting portion and a compressive transitional portion located between and electrically connecting the rigid contacting and mounting portions, the rigid contacting portion partially and movably protruding beyond the top surface of the insulative housing and adapted to electrically connect with a first electronic device, the rigid mounting portion being retained to the insulative housing and being adapted to electrically connect with a second electronic device, thereby establishing an electrical connection between the first and the second electronic devices; wherein the compressive transitional portion of each compressive conductive contact is a spiral spring; wherein the rigid contacting portion of each compressive conductive contact comprises a head section partially protruding beyond the top surface of the insulative housing, a connecting section received by a first end of the compressive transitional portion and a middle section between the head and the connecting sections; wherein the middle section has a shoulder proximate to the head section and each passageway of the insulative housing comprises a channel portion, an accommodating portion and a retaining portion, a stop wall being formed between the channel portion and the accommodating portion and being engageable with the shoulder of the middle section; wherein the rigid mounting portion of each compressive conductive contact defines a through hole extending therethrough and having a receiving section receiving a second end of the compressive transitional portion therein; wherein the rigid mounting portion of each compressive conductive contact is formed with a plurality of barbs on an outer surface thereof and the retaining portion of each passageway defines a plurality of slits in an inner wall thereof to mate with the barbs; wherein the rigid mounting portion of each compressive conductive contact comprises an enlarged section located below the barbs and stopped by the bottom surface of the insulative housing.

* * * * *